US005743271A

United States Patent [19]

Royo-Salvador

[11] Patent Number: 5,743,271

[45] Date of Patent: Apr. 28, 1998

[54] CERVICAL RECLINATION CUSHION

[75] Inventor: Miguel B. Royo-Salvador, Barcelona, Spain

[73] Assignee: Instituto Vesalio S.L., Barcelona, Spain

[21] Appl. No.: 832,533

[22] Filed: Apr. 3, 1997

Related U.S. Application Data

[63] Continuation of Ser. No. 489,431, Jun. 12, 1995, abandoned, which is a continuation of Ser. No. 215,565, Mar. 22, 1994, abandoned.

[51] Int. Cl.[6] ..... A61F 13/12

[52] U.S. Cl. ..... 128/845

[58] Field of Search ..... 128/845, 857, 128/848, 869, DIG. 13; 5/637, 636, 643; 602/17, 18

[56] References Cited

U.S. PATENT DOCUMENTS

| | | | |
|---|---|---|---|
| 3,482,571 | 12/1969 | Behrendt | 5/637 |
| 4,058,112 | 11/1977 | Johnson | 128/857 |
| 4,218,792 | 8/1980 | Kogan | 5/636 |
| 4,768,246 | 9/1988 | Summer . | |
| 4,773,107 | 9/1988 | Josefek . | |
| 4,918,774 | 4/1990 | Popitz | 5/636 |
| 5,014,377 | 5/1991 | Dixon | 5/636 |
| 5,018,231 | 5/1991 | Wang | 5/636 |
| 5,163,194 | 11/1992 | Dixon | 5/636 |
| 5,210,894 | 5/1993 | Minton | 5/637 |

FOREIGN PATENT DOCUMENTS

| | | | |
|---|---|---|---|
| 1231787 | 1/1988 | Canada . | |
| 2263740 | 11/1975 | France | 5/637 |

*Primary Examiner*—Jessica Harrison
*Assistant Examiner*—Michael O'Neill
*Attorney, Agent, or Firm*—Birch, Stewart, Kolasch & Birch, LLP

[57] ABSTRACT

A cervical reclination cushion including a one-piece body of rectangular prismatic structure, having a central depression, in the form of an enlarged softened imprint of the occipito-cervical region. On each side the central depression surfaces are provided for supporting a person's head when the person is lying on his side. The cushion is applicable to patient's suffering from disorders of the backbone, or persons who may only rest when lying down with an exact support, in the natural physiological position of the cervical column.

1 Claim, 1 Drawing Sheet

Fig. 1
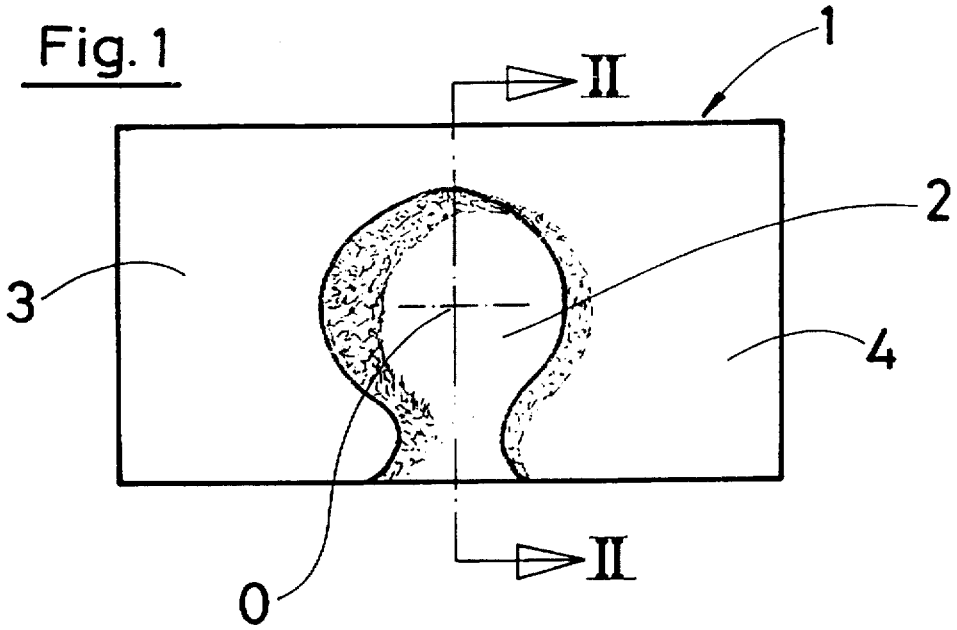
Fig. 2
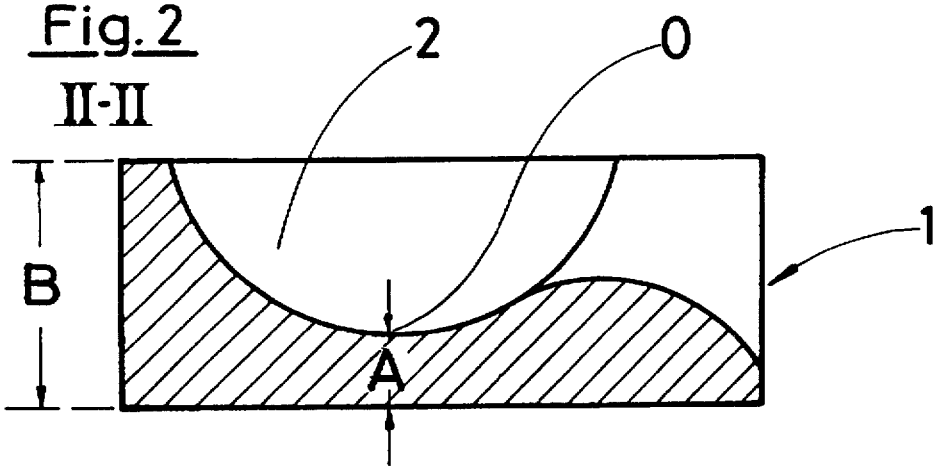
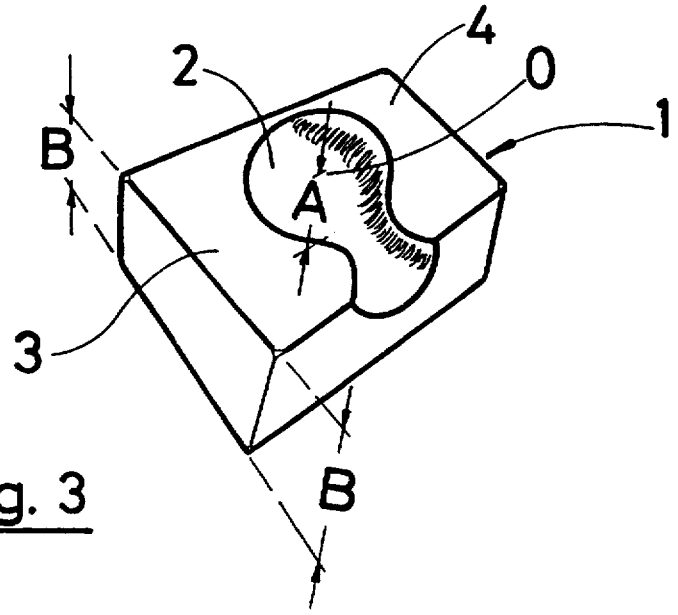
Fig. 3

CERVICAL RECLINATION CUSHION

This application is a continuation of application Ser. No. 08/489,431 filed on Jun. 12, 1995, now abandoned, the contents of which are hereby incorporated by reference; which is a continuation of application Ser. No. 08/215,565 filed on Mar. 22, 1994, now abandoned, the contents of which are hereby incorporated by reference.

FIELD OF THE INVENTION

The present invention relates to a cervical reclination cushion which provides support for maintaining the cervical region in the natural physiological position, aligned with the patient's backbone.

BACKGROUND OF THE INVENTION

Several types of pillow marketed through chemists, orthopaedic shops and other specific establishments as cushions of alleged medical design, with the claim that their use produces beneficial effects for the user thereof are known. Nevertheless, these cushions, which form the present state of the art, are characterized and distinguished from one another only in the merely formal aspect, adopting therefor fanciful designs of anatomical appearance, which are not the result of a genuine scientific study, nor do they provide relevant physiological improvements, but rather subjective ones.

The above is easily understandable, even for one not versed in the art, since it is logical that a cushion of the above type, devised for the alleged functions, on being completely mass produced, cannot be either appropriate or applicable indistinctly to all kinds of persons having varied constitutions. The prior art pillows do not meet the necessary conditions to adapt to the two positions of the head, in the two lying down positions: on the back and on the side. This is because the dimensions across the external occipital protuberances relative to a tangential plane passing through the back region and the dimension across a plane passing through the deltoid muscle, tangential thereto, and the pterygium point of the skull, are variable in each individual.

Currently the patient tries to overcome these deficiencies by means of forced positions which harm his health, or by deforming and folding the cushion, in an attempt to achieve the heights appropriate for such lying down positions, which is uncomfortable and does not solve the problem in a rational way.

SUMMARY OF THE INVENTION

The present applicant, thanks to his experience in the medical field, most particularly in the treatment of patients suffering from cervical column disorders, which require rest in the lying down position with a very precise support, in the natural physiological position of the cervical column, without there being forced positions of the different parts of the cervical region, has devised a cervical reclination cushion. The cervical reclination cushion is specifically applicable to such patients and may be used by any person, since the structure and configuration of such cushion allow an exact support to be obtained for the suitable placement of the cervical column, when lying down on one's back and on one's side. In the cushion, the low height required for supporting the occipito-cervical region in the supine position, ranging from 6 to 8 cms approximately, and the greater height required when lying on one's side, ranging from 10 to 15 cms approximately, is conjugated.

To this end, the cushion in question is formed by a rectangular prismatic body, provided with respective head supporting areas for the said lying down positions and in which, once the cushion material has been flattened under the weight of the head, respective heights result, comprised in the said dimensions cited in the foregoing paragraph, having the function of maintaining the cervical region in the most physiological position, aligned with the patient's backbone.

The aforesaid heights are obtained in an individualized way for each patient, whereby the design of the cushion is peculiar to each case, with idea that the results derived from the use thereof should be optimal.

The cervical reclination cushion of the invention provides the advantages mentioned before, further to others which will be easily gathered from the embodiment of a cushion, described in detail hereinafter to facilitate the intelligibility of the abovementioned features, while at the same time disclosing certain details. For such purpose, the present description is accompanied by drawings in which, only as a non-limiting example of the scope of the present application, there is shown a practical embodiment of the object thereof.

The present invention will become more fully understood from the detailed description given hereinbelow and the accompanying drawings which are given by way of illustration only, and thus are not limitative of the present invention, and wherein:

BRIEF DESCRIPTION OF THE DRAWINGS

FIG. 1 is a top plan view of the cushion, according to the model.

FIG. 2 is a cross section view of the cushion, seen on line II—II of FIG. 1.

FIG. 3 is a perspective top view of the cushion.

DESCRIPTION OF AN EMBODIMENT OF THE INVENTION

As shown in the drawings, the cervical reclination cushion of the present invention, according to one embodiment thereof, comprises a one-piece body of rectangular prismatic structure, generally designated with 1, having a central hollow or depression 2, in the form of a softened, enlarged imprint of the occipito-cervical region. This hollow is for supporting the head in the supine position.

On both sides of the central hollow 2 there are surfaces 3 and 4 for supporting the head when the person is lying on his side.

Once the material has been compressed under the weight of the head, the height from the central point or lowermost "O" of the hollow 2 to the horizontal plane is the distance "A".

The height of the side masses forming the surfaces 3 and 4, once the material has been compressed under the weight of the head, is the distance "B".

To obtain the dimension "A", the distance from the external occipital protuberance to a tangential plane passing through the dorsal region a hard flat surface against which the dorsal region is applied. This measurement of the size "A" extends from the central portion of the cushion 1, point "O", marking the central of the cavity or hollow made in the cushion to the tangential plane.

With regard to the dimension "B", on both sides of the hollow 2 there are located the lateral masses 3 and 4, the height of which is the person's ear region to a distance from the plane which is tangential to the person's shoulder on the same side. In other words, if a person stands straight up with one shoulder against a wall, approximating a plane tangential to the shoulder, then the dimension "B" would be the distance from the wall to the person's ear. There may be two type "B" dimensions, corresponding to the left side and to the right side, when the measurement on the right side is different from that of the left side.

The cushion 1 may be made of many materials, provided that they maintain the aforementioned distances "A" and "B" and provide a resilient, comfortable consistency.

As far as the compressibility of the different materials forming the different textures of the cushion are concerned, the dimensions "A" and "B" will be those of the cushion once the material has been compressed under the weight of the head.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A cervical reclination cushion for supporting a person's head, comprising:

a rectangular prismatic body including three support surfaces;

a first of said three support surfaces formed by a central hollow having the form of an enlarged imprint, rounded at the edges thereof, of a person's occipito-cervical region, for adaptation thereto in the supine position; and a second and a third of said three support surfaces formed by two masses of cushion on both sides of said central hollow and defining planar surfaces for supporting a person's head when the person is lying on his side, said second and third of said three support surfaces each being at least as wide as one-half of a width of said central hollow, said cervical reclination cushion supporting a person's cervical region to be maintained in a natural physiological position, aligned with an axis of the person's backbone when the person is lying on his back or on his side.

wherein a distance between a center of the central hollow of the cushion and a base of the cushion ranges from 6 to 8 cms, with said distance exact for each case corresponding to the distance between the external occipital protuberance to a tangential plane passing through the dorsal region, wherein a height of said two masses of cushion ranges from 10 to 15 cms, an exact height corresponding to a measurement from a plane tangential to a person's shoulder up to a person's ear region on a same side, and wherein said height of said two masses is approximately twice the distance between the center of the central hollow and the base of the cushion.

* * * * *